US005199241A

United States Patent [19]

Gorby et al.

[11] Patent Number: 5,199,241

[45] Date of Patent: Apr. 6, 1993

[54] CAN STAR DRIVE FOR SOLID PACK TUNA CANNING MACHINES

[75] Inventors: Jack Gorby, Los Angeles; Edward J. Rowley, Azusa, both of Calif.

[73] Assignee: Sea-Pac, Inc., Gardena, Calif.

[21] Appl. No.: 814,150

[22] Filed: Dec. 30, 1991

[51] Int. Cl.[5] ..... B65B 63/02

[52] U.S. Cl. ..... 53/122; 53/252; 53/253; 53/517; 53/529; 100/910; 426/513

[58] Field of Search ..... 426/397, 513; 100/223, 100/910; 53/122, 252, 253, 517, 527, 529

[56] References Cited

U.S. PATENT DOCUMENTS

| | | | |
|---|---|---|---|
| 2,092,773 | 9/1937 | Nordquist et al. | 53/252 X |
| 2,542,133 | 2/1951 | Gorby | 426/513 X |
| 2,926,095 | 2/1960 | Gorby | 53/253 X |
| 3,123,958 | 3/1964 | Carruthers | 53/517 |
| 3,332,202 | 7/1967 | Van Snellenberg | 53/517 |
| 3,585,785 | 6/1971 | Smith | 53/252 |
| 3,700,386 | 10/1972 | Mencacci | 53/517 X |
| 4,116,600 | 9/1978 | Dutton et al. | 53/517 X |
| 4,641,487 | 2/1987 | Darecchio | 53/517 X |

*Primary Examiner*—John Sipos
*Assistant Examiner*—Daniel B. Moon
*Attorney, Agent, or Firm*—Phillips, Moore, Lempio & Finley

[57] ABSTRACT

A can star drive for a fish-canning machine in which a turret 11 and can star 75 are separately driven, with the can star 75 being rotated through its 120° advance in each cycle during half again as much time as it takes for the turret 11 to advance through its 120° advance. The slower rate of rotation of the can star 75 reduces the exit velocity of the filled cans as they are discharged from the machine to avoid ejection of fish from filled cans. In addition, the can star 75 rotates through its 120° continuously in a one-step advance, rather than through a two-step advance with an intermediate stop as in prior machines.

7 Claims, 3 Drawing Sheets

CAN STAR DRIVE FOR SOLID PACK TUNA CANNING MACHINES

This invention relates to fish-canning machines and particularly to a turret-type of solid pack machines as shown in U.S. Pat. No. 4,116,600, issued on Sep. 26, 1978 to Edward E. Dutton and Jack Gorby, the disclosure of this patent being incorporated herein by reference.

Solid pack machines in accordance with U.S. Pat. No. 4,116,600 are as shown in FIG. 1 herein, such figures also being FIG. 1 in said patent. Such a machine comprises a pair of rotatable turrets 11 and 12 mounted for rotation about a common axis. Turret 11 has three fish-receiving pockets 13 spaced equidistantly around the periphery thereof and openings 14 between each pair of adjacent pockets 13. Turret 12 has six equidistantly spaced fish-receiving pockets around its periphery. When the turrets are positioned as in FIG. 1, every other pocket 15 of turret 12 is in axial alignment with a pocket 13 of turret 11 and each of the other pockets 15 is in axial alignment with one of the openings 14 through turret 11.

Three operating stations are spaced around the peripheries of the turrets. The first or feed station 16 comprises the feed chute 17 and a reciprocating volume knife 18 which moves between the end of the feed chute 17 and the peripheries of turrets 11, 12. A pivotal divider knife 19 moves between the turrets and the feed chute to sever fish that have been fed into the pockets at station 16.

A second operating station 20 comprises a former plunger 21 mounted for axial reciprocatory movement into and out of a pocket 15 of turret 12, and a knock-out plunger 22 adapted to move axially into and through a pocket 15 of turret 12 and the aligned opening 14 of turret 11 to eject fish into a can 23 and then move back out of the opening 14 and pocket 15.

The third station 24 is similar to the second station and includes a former plunger 25 associated with a pocket 13 of turret 11 and a knock-out plunger 26 adapted to move through aligned pockets of the turrets to eject fish from a pocket 13 of turret 11 into another can 23.

If desired, a fourth operating station 27 may be provided, this station comprising a lock plunger 28 movable radially of the turrets into and out of aligned pockets of the turrets thereat for locking the turrets against rotation. This station is necessary only if the indexing drive for the turrets does not itself provide sufficient locking of the turrets in the dwell period between rotation of the turrets from the first station to the second and third stations.

The machine also includes a conveyor belt 30 which delivers fish loins to the feed chute 17, the loins entering the chute through the side opening 31 thereof. A loin knife 32 is positioned to move down across the side opening 31 and sever the loins fed into the chute, the loins then being moved down the chute towards the turrets by ram 33. A vertically movable tamper 34 facilitates entry of fish loins into the feed chute.

In operation, fish loins are fed into the combined and aligned pockets 13 and 15 at the feed station, and the volume knife 18 cuts through the fish extending from the pockets back into the feed chute. Turrets 11 and 12 are then rotated in unison through 60° so that the filled pocket 15 of turret 12 is at station 20. Turret 11 is rotated through an additional 60° so that its filled pocket 13 is at station 24. In U.S. Pat. No. 4,116,600, this 120° rotation of turret 11 takes place during approximately 180°, or one-half, of a 360° cycle of operation. In commercial machines, such rotation may be accomplished in about 160° of a 360° cycle of operation. The turrets then dwell for the remainder of the 360° cycle.

During the dwell period of the turret in an operating cycle, the two former plungers 21 and 25 move in unison into the filled pockets 15 and 13 to compress and form the fish into cylinders. At the end of the forming operation and while the fish is still compressed by plungers 21 and 25, the knock-out plungers 22 and 26 move in unison into the pockets 15 and 13 to eject the formed fish into cans 23.

Also during the dwell period, the empty pockets 13 and 15 that were brought to the feed station 16 by the rotation of the turrets will be filled.

After the fish has been ejected from the turret pockets into the cans during the dwell period, another cycle start, with the turret 11 and 12 being again advanced as above. During this turret advance, a can star fixed to turret 11 coaxially therewith will rotate 120° to move the filled cans to discharge into a can guide and to bring two empty cans into alignment with the again-filled pockets at the second and third stations.

In operation, these machines have proved to be very satisfactory in their ability to process fish loins, form them into cylindrical charges and to eject the charges into cans at a high rate of speed. Although originally designed to operate at 180 cans per minute, it has been found that the machine will perform these functions satisfactorily when the machine is speeded to operate a rate of 230 cans per minute.

It has been found, however, that in such high speed operation, some or all of the contents of an occasional can will be thrown out of the can as it is discharged from the machine. This problem occurs at times during normal speed of operation and increases in severity as the speed of the machine is increased. Although the underweight cans will be detected down the line, with the cans being then removed from the line or manually filled to bring the contents up to weight, these occurrences undesirably increase the labor cost and the loss of fish.

It is the principal object of the invention to eliminate or drastically reduce the instances of some or all of the contents of a filled can being thrown out of the can in a machine of the type described above without reducing the cans per minute output of the machine.

SUMMARY OF THE INVENTION

In analyzing the performance of the machine the inventors have found that the main reason for the contents being thrown from the cans as the cans were discharged from the machine during high speed operation was because of the high velocity of the discharging cans. To overcome this problem, the exit velocity of the cans is substantially reduced so that the exit velocity of the cans when the machine is operating at a production rate of 230 cans per minute is substantially less than the exit velocity of the prior machine when operating at a production rate of 180 cans per minute.

In order to achieve this reduction in exit velocity of the cans from the machine, even when the machine is operating at a greater than normal capacity, the prior machine is modified so that instead of the can star being fixed to the three-pocket turret, a separate can drive means is provided which will hold the can star against rotation with two of its can holders positioned at the second and third operating positions during the time in an operating cycle that the knock-out plungers eject the formed fish cylinders into the cans and which then rotate the can star from one indexed position to the next during substantially the rest of the operating cycle. This increases the length of time in a cycle of operation that the can star takes to move from one indexed position to the next and consequently reduces the angular velocity of the star wheel and the exit velocity of the filled cans.

Other objects and advantages will become apparent in the course of the following detailed description of the invention.

BRIEF DESCRIPTION OF THE DRAWINGS

In the drawings, forming a part of this application, and in which like parts are designated by the like reference numerals throughout the same.

DESCRIPTION OF THE PREFERRED EMBODIMENTS

Figure 1:
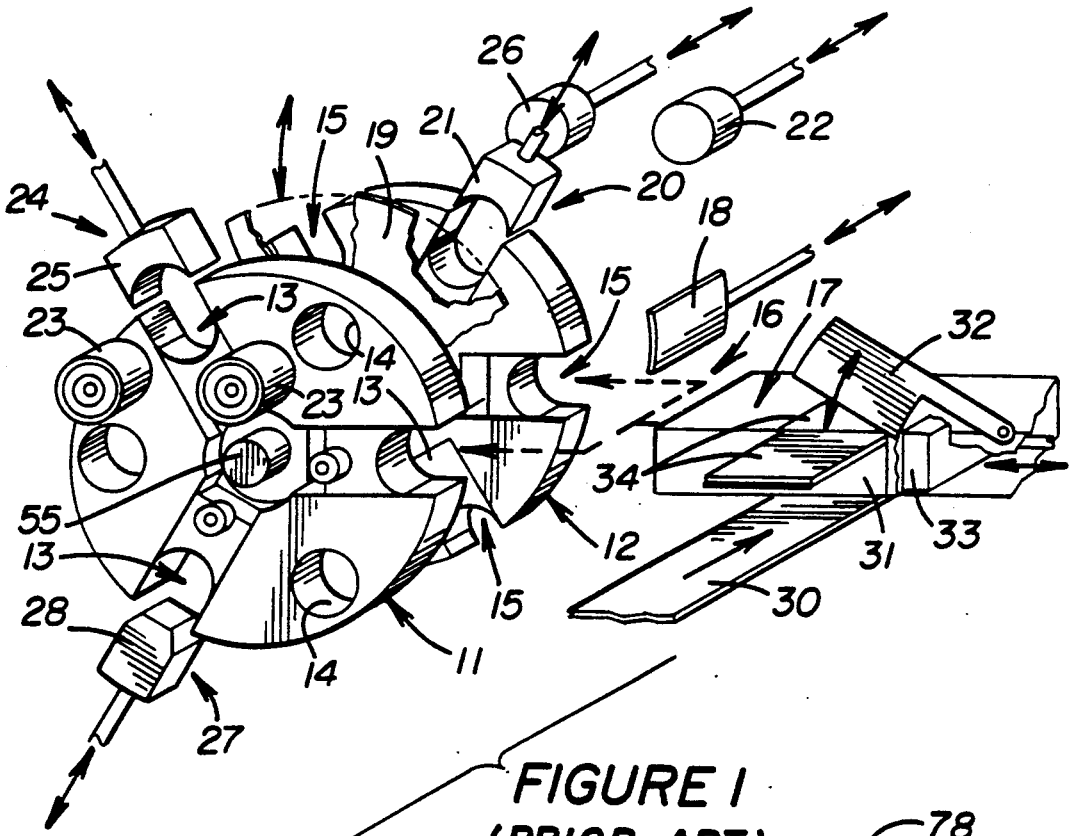
FIGURE 1 (PRIOR ART)
FIG. 1 is a schematic exploded view of the rotatable turrets and the operational stations around the peripheries thereof of the type of machine with which the present invention is used.
Figure 2:
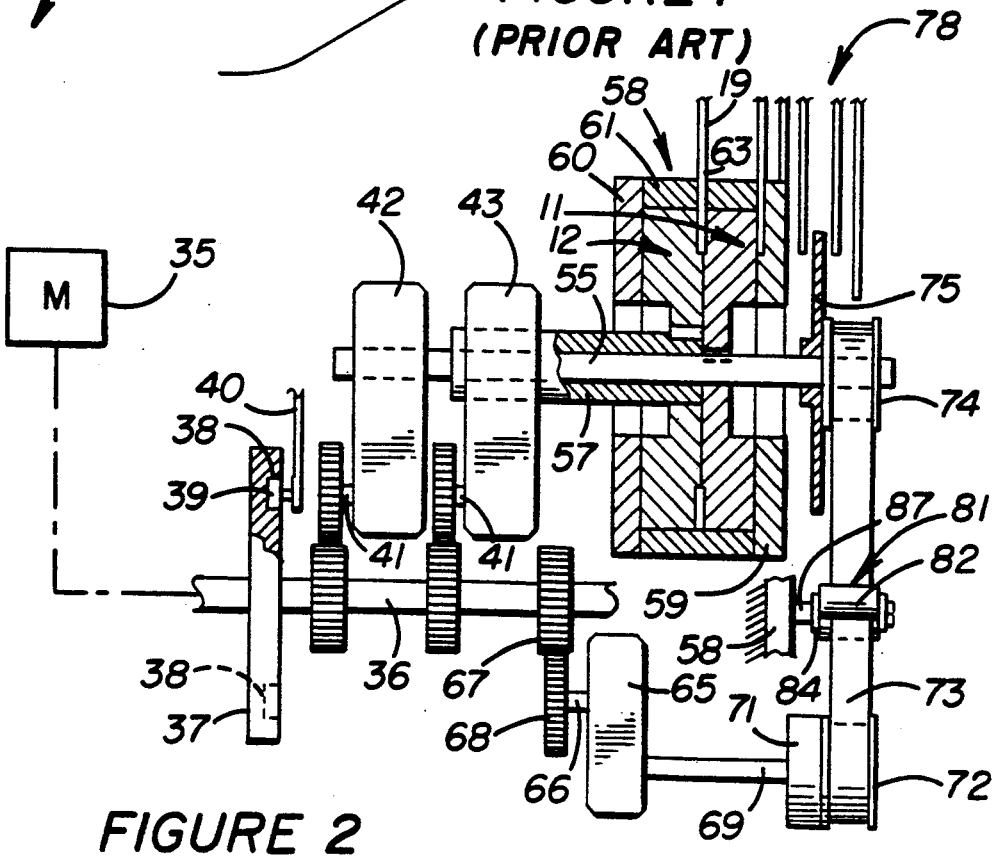
FIG. 2 is a sectional view in elevation of a portion of the machine of FIG. 1 illustrating the turrets and drive mechanisms therefor and illustrating the drive means for the can star of the machine.
Figure 3:
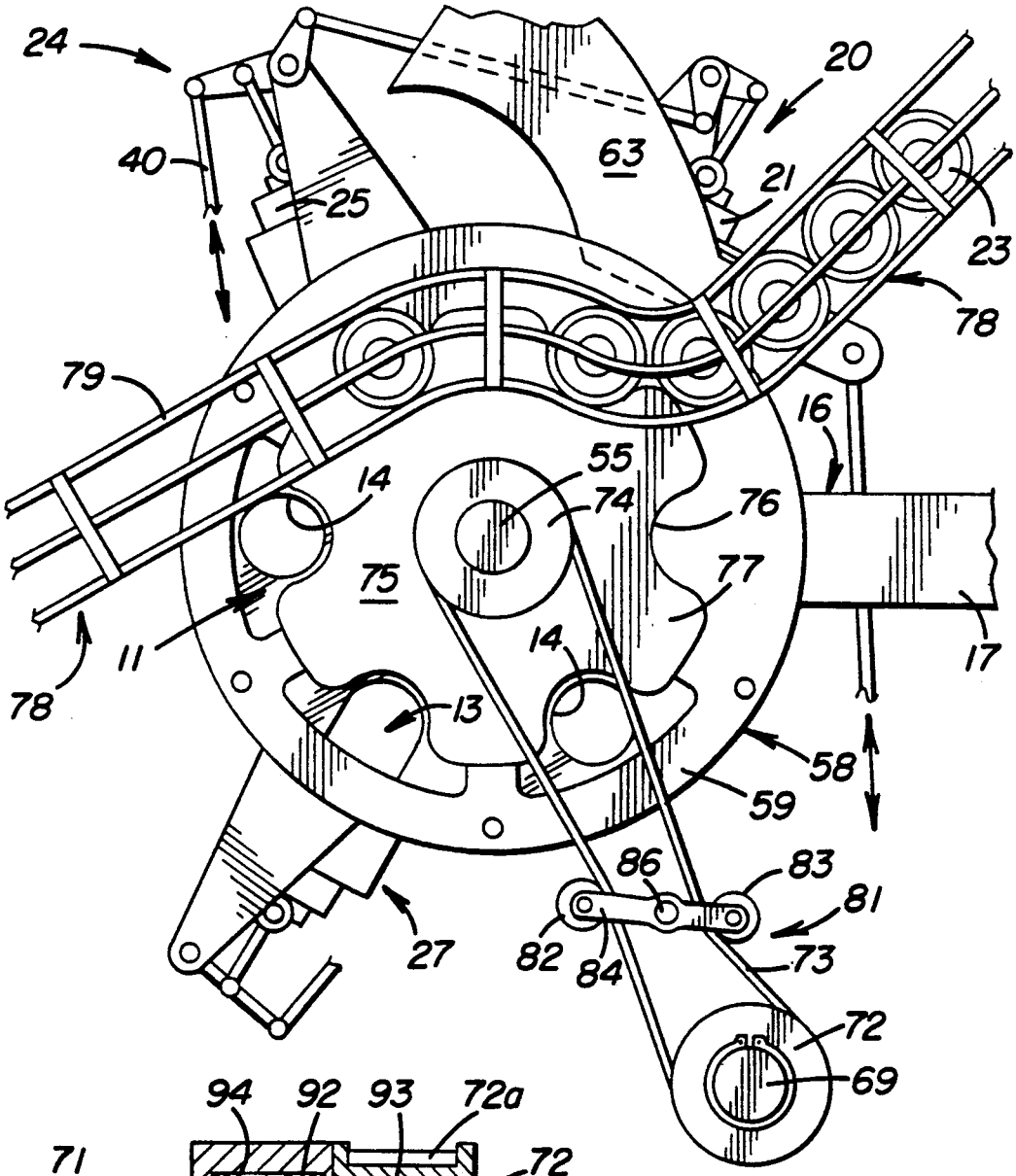
FIG. 3 is a front elevational view of the machine of FIG. 2.

Referring now to the drawings, wherein a preferred embodiment of the machine is shown, and with particular reference to FIG. 2, the machine includes a motor 35 suitably arranged to drive the main shaft 36 which is conventionally journaled in the frame of the machine for rotation. Positive cam 37, shown in FIG. 2, is illustrative of the various cams which are mounted on the main drive shaft 36 for rotation therewith, the cams being used to actuate the various elements of the machine. Cam 37 has a cam track 38 in the face thereof in which cam roller 39 rides. The movement of the roller 39 towards and away from the axis of the shaft 36 in turn causes a movement of the cam follower arm 40 on which the roller is mounted. The cam follower arm 40 may, for example, be used to actuate the plungers 21 and 25 at the second and third operating stations 20 and 24 (FIG. 3).

Shaft 36 is also coupled to the input shafts 41 of the two indexing drive units 42 and 43. Shaft 55 is the output shaft of indexing drive unit 42 and has turret 11 splined thereon. Shaft 57, coaxial to and surrounding shaft 55, is the output of indexing drive unit 43 and has turret 12 spline connected thereto. Shafts 55 and 57 are suitably journaled in the frame of the machine for rotation about a fixed and common axis.

The function of the illustrated indexing drive unit 42 is to rotate output shaft 55 and advance turret 11 through two successive 60° increments for each complete revolution of main shaft 36, with such rotation of turret 11 taking place during 180° of rotation of shaft 36. Indexing drive unit 43 rotates output shaft 57 and advances turret 12 through a single 60° increment for each complete revolution of shaft 36, such rotation of turret 12 occurring during 90° of rotation of shaft 36. The indexing units hold shafts 55 and 57 at their indexed position during the remainder of a single revolution of shaft 36. Indexing drive units for intermittent stepwise advance, as described above, are commercially available, and are accordingly not described in detail. For example, indexing drive units as used in the present invention are obtainable from Ferguson Machine Company of St. Louis, Mo. Turrets 11 and 12 are enclosed by stationary housing 58, the housing having opposed end plates 59 and 60 adjacent the faces of the turrets. An arcuate wall 61 covers a portion of the peripheries of the turrets, leaving the remainder of the peripheries exposed for cleaning purposes. Housing 58 is suitably fixed to the frame of the machine.

Dead plate 63, shaped the same as divider knife 19 is pivotably mounted for movement with knife 19. The inner side of the housing end plate 59 is cut away to allow the dead plate to move between the end plate 59 and the adjacent face of turret 11. The dead plate 63 will close off the pocket 13 of turret 11 which is at the third operating station 24 so that forming can occur therein.

In accordance with the present invention, a third intermittently advancing indexing drive unit 65 is provided, this drive unit 65 having an input shaft 66 driven by the main drive shaft 36 by intermeshed gears 67 and 68. The indexing drive unit 65 functions to rotate its output shaft 69 through a 120° advances during 270° of rotation of the main drive shaft 36 and to hold the output shaft 69 against rotation during the remaining 90° of rotation of the drive shaft 36.

The output shaft 69 is coupled through overload clutch 71 to a toothed sprocket 72. A toothed timing belt 73 is trained around sprocket 72 and sprocket 74, the latter being fixed coaxially to can star 75. The integral can star 75 and sprocket 74 are freely journaled (by suitable bearings not shown) on shaft 55 so that shaft 55 and can star 75 can rotate independently of each other. The sprockets 72 and 74 have the same number of teeth 72*a* (FIG. 4) so that the can star 75 will be advanced through 120° on 270° of rotation of the main drive shaft 36 and will dwell during the other 90° of rotation of the main drive shaft each time the main drive shaft rotates through 360°.

Referring now to FIG. 3, the can star 75 has six can holding recesses 76 equidistantly spaced around the periphery of the can star and separated by lobes 77. A can guide 78 mounted in fixed relation to the machine and housing 58 thereof delivers empty cans 23 to the can star 75 and takes filled cans away therefrom in a conventional manner. The can star 75 when in its dwell position will be as shown in FIG. 3 with the can holders 76 holding a can at each of the second and third operating stations 20 and 24 for filling thereof. When the can star is rotated through 120° it will deliver the two filled cans to the discharge portion 79 of the can guide 78, and will pick up two empty cans and bring them to the second and third operating stations 20 and 24.

A belt tensioner 81 is provided to maintain the belt at a desired tension so that the dwell position of the can star 75 will maintain the cans 23 in alignment with the turret pockets 13 and 15. The belt tensioner comprises two idler pulleys 82 and 83 mounted on a pivotal frame 84 and in engagement with the outer surfaces of timing belt 73. The frame 84 is pivoted about bolt 86 to vary the tension in the belt. When the tension is as desired, bolt 86 is tightened to the housing 58. Lock washer 87 retains the belt tension in its adjusted position.

Figure 4:
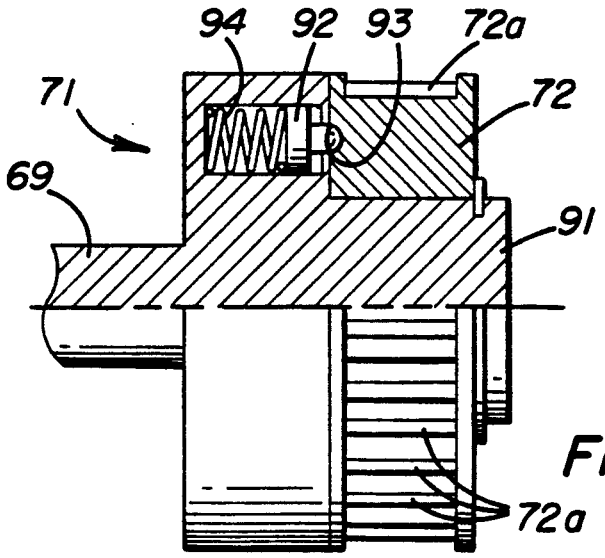
FIG. 4 is a simplified sectional view of the overload clutch in the can star drive.

FIG. 4 illustrates the details of the overload clutch 71. As shown therein sprocket 72 is mounted on the end hub 91 of the output shaft 69 for rotation thereon but is normally coupled to the hub 91 by plunger 92 having a rounded end extending into a detent 93 in sprocket 72 and maintained therein by the force of spring 94. If the can star jams so that sprockets 72 and 74 can not rotate, the force of the rotating output shaft 69 would cam the plunger out of the detent so that the hub 91 can rotate freely within the sprocket 72.

For purposes of definition, the above-described element 65–69, 71–74, 81 and components of clutch 71 and belt tensioner 81 constitute a can star drive means.

The advantages of the can star drive means of the present invention can best be explained by comparison to the operation of a prior art machine as exemplified by the aforesaid U.S. Pat. No. 4,116,600.

Figure 5:
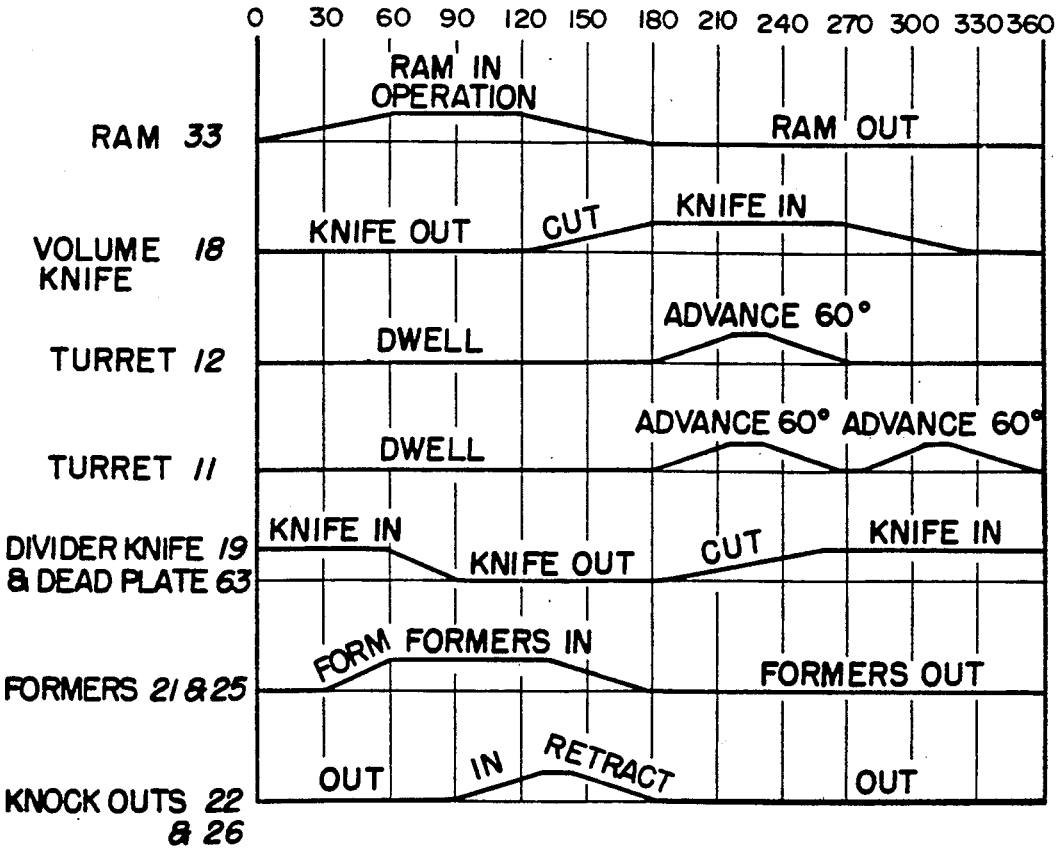
FIG. 5 is a timing chart illustrating the sequence of operation of various indicated components of the prior and present machines.
Figure 6:
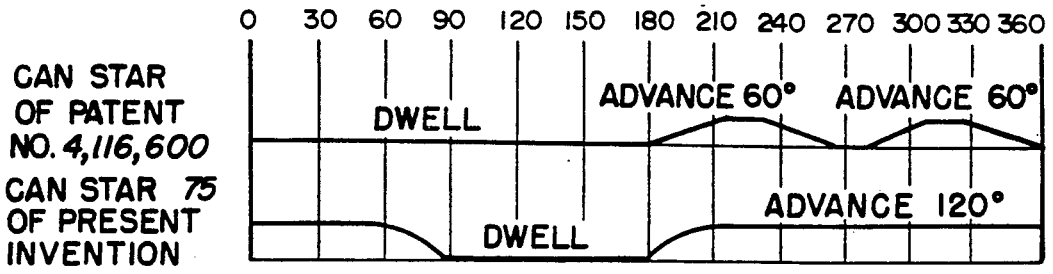
FIG. 6 is a timing chart illustrating the sequence of operation of the can stars of the prior and present machines.

FIG. 5 illustrates the operation of various components common to the prior art and present machines in a full cycle of the operation of the machines, i.e. for a 360° of rotation of the main drive shaft 36. FIG. 6 is a comparative illustration of the full cycle of operation of the can stars of the prior art and present machines.

As shown in FIGS. 5, turrets 11 and 12 rotate during part of a cycle through two 60° advances and a single 60° advance, during the same 180° of rotation of the main drive shaft 36, and then they both dwell in indexed positions for an 180° remainder of a cycle. Forming of the fish in pockets 13 and 15 occurs during that remainder of the cycle. The knock-out plungers then operate in during a portion of the remainder of a cycle, e.g. in the last 90° of the 180° of dwell of the turrets.

In the prior art machine the can star was fixed to turret 11 and rotated in unison therewith. As seen in FIG. 6, such can star rotated through two 60° increments during 180° of rotation of the main drive shaft 36. In operation of a machine at a rate of 180 cans per minute, the can star would advance through 2.094 radians (120°) 90 times a minute, or through 3.141 radians in a second. Since the can star only advances during half (180°/360°) of each cycle the average angular velocity ($\omega$) of the can star during its rotation is $3.141 \times 2 = 6.282$ radians per second. Commercial embodiments of the U.S. Pat. No. 4,116,600 machine have a can star with a 0.531 foot (16.2 cm) radius from the axis of the can star to the center of a can held thereby. The average tangential velocity ($\omega$) of a can is 3.34 feet/second (102 cm/sec) during the time that the can star is moving the can. Since a considerable amount of time is required in each 60° advance of the turret 11 and can star for acceleration from rest and deceleration to a stop the peak velocity of the can is considerably higher than the average velocity.

During a cycle of operation of the prior art can star, the filled can at the third operating station 24 will be accelerated to peak velocity and discharged down the can guide. Likewise, the filled can at the second operating station 20 will be accelerated to its peak velocity but will then decelerate quickly and come to a stop as the turret 11 stops after a 60° advance. The can star will immediately begin another 60° advance, accelerating the filled can to peak velocity, with the can being then discharged down the can guide. This two step advance of the filled can from the operating station 20 with a sudden stop inbetween will tend to cause ejection of part or all of the contents.

FIG. 6 also illustrates the operation of the can star 75 of the present invention. As seen therein, the can star 75 advances 120° in 270° of rotation of the main drive shaft 36. There is considerably more time in each cycle of operation for the can star to make its 120° advance, i.e. 270°/360° as compared to 180°/360° for the prior art. The average angular velocity of the can star 75 during the time that it is rotating will be 4.19 radians per second for an operating speed of 180 cans per minute, and the tangential can velocity will be 2.22 feet per second.

Thus, at a can rate of 180 cans per minute, the average can velocity with the present invention is $\frac{2}{3}$ that of the machine with the prior art can star drive. Even at a machine operating speed of 230 cans per minute the average can velocity with the present invention is 2.84 feet per second (86.6 cm/sec), which is still considerably less than the can velocity of the prior art machine when operating at 180 cans per minute.

Moreover, as is seen in FIG. 6, the acceleration and deceleration of the can star 75 takes a much smaller portion of the time that the can star is advancing so that the peak velocity is much closer to the average velocity than with the prior art can star drive.

Further, and importantly, the can star 75 advances continuously through its 120° advance so that the filled can at station 20 is not subjected to the jolt of a stop on its way to discharge as is the case with the prior art machine.

The lower can ejection velocities, both average and peak, and the continuous movement of the can from operating station 20 to the discharge have been found to reduce significantly the ejection of contents from filled cans.

Although the present invention has been described with reference to a machine wherein the turret 11 has three-pockets 13 and turret 12 and can star 75 has double that number of pocket 15 and can holders 76, other similar machines could be built wherein turret 11 has N number of pockets (N being an integer) and wherein turret 12 and can star 75 have 2N pockets 15 or can holders 76, without affecting the general functioning of the invention and as described above.

The foregoing description of the preferred embodiment has been presented for purposes of illustration and description. It is not intended to be exhaustive or to limit the invention to the precise form described, and obviously many other modifications are possible in light of the above teaching. The embodiment was chosen in order to explain most clearly the principles of the invention and its practical application thereby to enable others in the art to utilize most effectively the invention in various other modifications as may be suited to the particular use contemplated. It is intended that the scope of the invention be defined by the claims appended hereto.

I claim:

1. In a cyclically-operating fish-canning machine having first and second turrets rotatable about a common axis, each turret having a plurality of fish-receiving and forming pockets therewithin which extend through the turret from side-to-side thereof and a pocket entrance through the periphery of the turret, the first turret having N pockets spaced equidistantly around its periphery, N being an integer, and the second turret having 2N pockets spaced equidistantly around its periphery, said machine having first, second and third spaced-apart operational stations adjacent the peripheries of said turrets, said turrets being positionable at said first station with one pocket of both of said turrets being in alignment with each other, means at said first station for filling both of the aligned pockets with fish, means for rotating said first turret through 360°/N and said second turret through 180°/N during a part of each cycle of operation to move the filled pockets thereof from said first station to said third and second stations, respectively, and to hold said turrets against rotation for a remainder of said cycle of operation, forming means at said second and third station for forming fish in said filled pockets thereat into desired shapes during said remainder of said cycle of operation, a can star rotatable coaxially with said turrets, said can star having 2N can holders spaced equidistantly around its periphery, can guide means for feeding cans to and taking cans away from said can star, and plunger means at said second and third stations for ejecting fish from said turret pockets into cans held by said can star can holders during a portion of said remainder of said cycle of operation, the improvement comprising:

can star drive means separate from said means for rotating said first and second turrets for (a) holding said can star against rotation with two of its can holders at said second and third stations respectively during the portion of a cycle that said plunger means operate to eject fish from said turret pockets, and for (b) rotating said can star through 360°/N during a length of time in the rest of said cycle of operation, which is substantially longer than the length of time that said first turret rotates through 360°/N during a cycle of operation.

2. In a cyclically-operating fish-canning machine as set forth in claim 1, wherein the means for rotating said first turret functions to rotate said first turret through 360°/N in no more than about one-half of a cycle of operation, and wherein said can star drive means functions to rotate said can star through 360°/N during about three-quarters of a cycle of operation.

3. In a cyclically-operating fish-canning machine as set forth in claim 2 wherein said can star drive means functions to rotate said can star continuously and in a single-step advance during its 360°/N of rotation.

4. In a cyclically-operating fish-canning machine as set forth in claim 1 wherein N=3 with respect to both of said turrets and to said can star.

5. In a cyclically-operating fish-canning machine as set forth in claim 1, wherein said machine includes a motor-driven main drive shaft and wherein said first and second turrets are intermittently driven by rotation of said main drive shaft with rotation of said first turret through 360°/N being produced by not more than about 180° of rotation of said main drive shaft and with dwelling of said first turret in an indexed position occurring during the balance of 360° of rotation of said main drive shaft, and wherein said can star drive means includes an intermittently advancing indexing drive having an input shaft driven by said main drive shaft and an output shaft, a first sprocket, means to rotate said first sprocket in response to rotation of said output shaft, a second sprocket secured to said can star coaxially therewith, and a timing belt trained around said sprockets, said indexing drive functioning to drive said can star through 360°/N during approximately 270° of rotation of said main drive shaft and to hold said can star in an indexed position during the balance of 360° rotation of said main drive shaft.

6. In a cyclically-operating fish-canning machine as set forth in claim 5, wherein said means to rotate said first sprocket in response to rotation of said output shaft includes an overload clutch means to normally couple said first sprocket to said output shaft and to uncouple said first sprocket from said output shaft in the event said can star and said first sprocket are unduly restrained from rotation.

7. In a cyclically-operating fish-canning machine as set forth in claim 5, wherein N=3 with respect to both of said turrets and to said can star.

* * * * *